United States Patent [19]

Miyasaka

[11] 4,282,592

[45] Aug. 4, 1981

[54] INDICATING MEMBER ADVANCING MECHANISM

[75] Inventor: Mamoru Miyasaka, Suwa, Japan

[73] Assignee: Kabushiki Kaisha Suwa Seikosha, Tokyo, Japan

[21] Appl. No.: 25,687

[22] Filed: Mar. 30, 1979

[30] Foreign Application Priority Data

Mar. 30, 1978 [JP] Japan ..... 53-37111

[51] Int. Cl.[3] ..... G04B 19/24; G04B 19/20; G04B 27/00; G04B 19/00

[52] U.S. Cl. ..... 368/37; 368/35; 368/28; 368/221

[58] Field of Search ..... 58/58, 4 A, 5, 125 B; 368/28, 35, 37, 64, 76, 77, 80, 220, 221

[56] References Cited

U.S. PATENT DOCUMENTS

| | | | |
|---|---|---|---|
| 3,540,207 | 11/1970 | Keeler | 58/23 R |
| 3,815,351 | 6/1974 | Vovelle | 58/4 A |
| 3,882,669 | 5/1975 | Jacob | 58/58 |
| 3,961,472 | 6/1976 | Riehl | 58/4 A |
| 4,026,100 | 5/1977 | Kume et al. | 368/37 |
| 4,198,808 | 4/1980 | Tamaru | 368/37 |

FOREIGN PATENT DOCUMENTS

| | | | |
|---|---|---|---|
| 2001187 | 1/1979 | United Kingdom | 58/58 |

*Primary Examiner*—B. Dobeck
*Assistant Examiner*—John B. Conklin
*Attorney, Agent, or Firm*—Blum, Kaplan, Friedman, Silberman and Beran

[57] ABSTRACT

An electronic analog calendar timepiece includes a mechanism for automatically correcting the date indication at the ends of months having less than 31 days. A second motor activates the month correction-mechanism in short months to advance the date dial by additional indicated days. Such irregular advancements occur in accordance with the condition of switches associated with the 29th, 30th, and 31st day positions of the date dial, and in accordance with data stored in memory to correlate with the displayed month of the year. A conventional driving mechanism associates with conventional time keeping circuitry to advance the hands and the day, date, and month indicators for all days occurring in the month. The month-end correcting mechanism is linked to the conventional driving mechanism by actuation of the second motor.

24 Claims, 13 Drawing Figures

FIG. 2
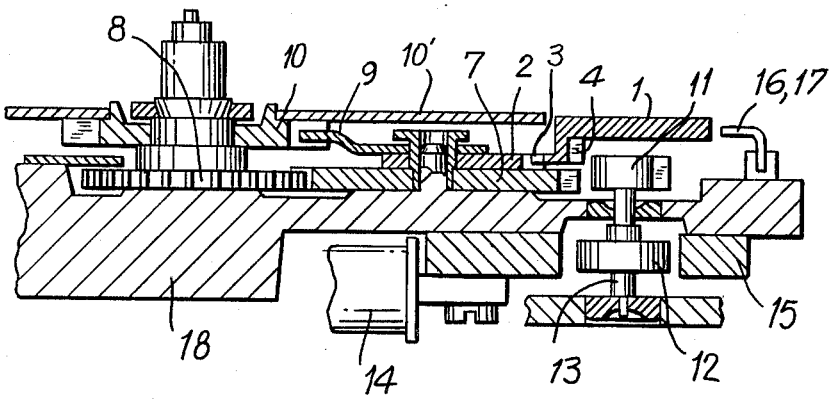
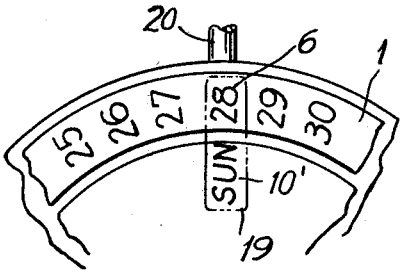
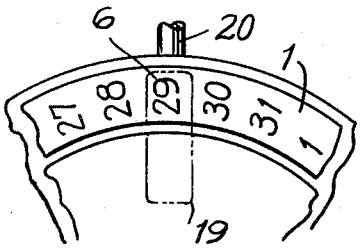
FIG. 3
FIG. 4

FIG. 5
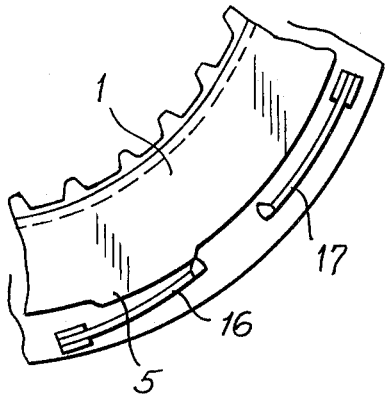
FIG. 6
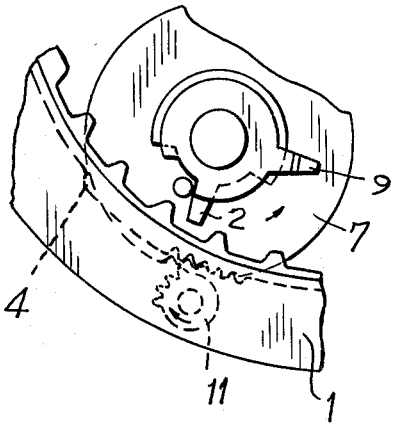
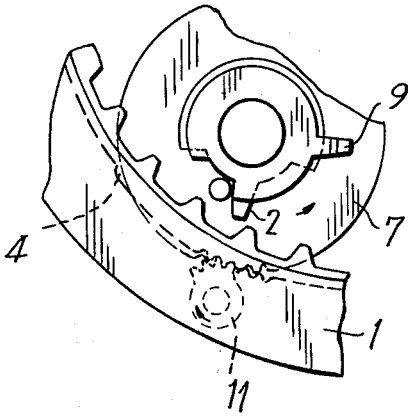
FIG. 7
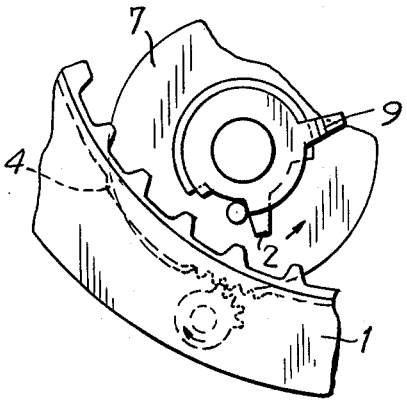
FIG. 8

FIG. 9
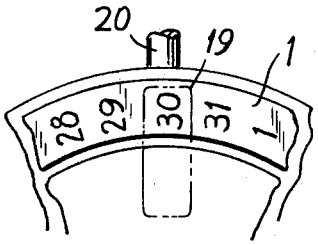
FIG. 10
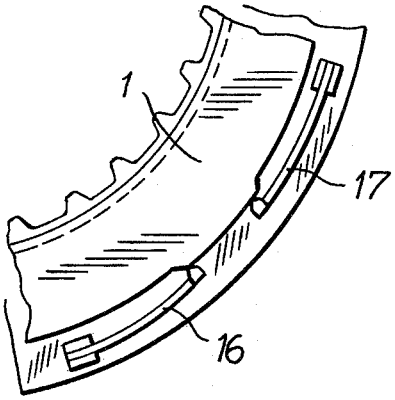
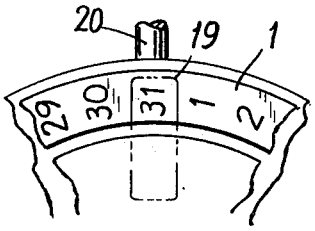
FIG. 11
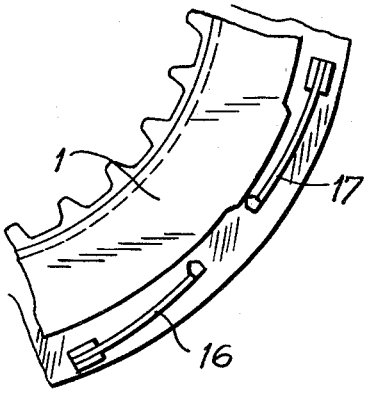
FIG. 12

INDICATING MEMBER ADVANCING MECHANISM

BACKGROUND

This invention relates generally to an electronic analog calendar timepiece of the type indicating day, date, and month in addition to the time of day, and more particularly to an electronic analog calendar timepiece which automatically corrects the date indicator at the end of months having less than 31 days. There are many analog calendar timepieces on the market which are capable of indicating date and day, however, in small timepieces, that is wristwatches, a month and automatic date adjusting mechanism has not been utilized primarily due to its complicated nature, insufficient reliability and dimensional problems. Accordingly, wristwatches of the prior art have required manual day correction at the end of every month having less than 31 days. Such manual correction has disadvantages in that the watch is interrupted in its timekeeping functions while correcting the date, and then the watch has to be adjusted to an accurate time setting again. Frequently, correction of date is forgotten by the user at the end of a short month and the watch is left indicating the wrong date. In fully electronic liquid crystal digital timepieces, most of the calendar indicating systems provide for automatic month-end date correcting systems.

SUMMARY OF THE INVENTION

Generally speaking, in accordance with the invention, an electronic analog calendar timepiece which automatically corrects the date indication at the ends of months having less than 31 days, is provided. In the timepiece, a second electric motor activates the month-end correcting-mechanism in short months to advance the date dial by additional indicated days. Such irregular advancements occur in accordance with the condition of electrical switches associated with the 29th, 30th, and 31st day positions of the date dial, and in accordance with data stored in memory to correlate with the displayed month of the year. A conventional driving mechanism associates with conventional electronic timekeeping circuitry to advance the hands and the day, date, and month indicators for all days actually occurring in the month. The month-end correcting mechanism is mechanically linked to the conventional driving mechanism by energization of the second motor. The date dial is automatically advanced to indicate the first day of a new month at the end of the preceding month regardless of the number of days in the preceding month.

Accordingly, it is an object of this invention to provide an improved analog calendar timepiece which automatically corrects the date indicator at the end of months having less than 31 days.

Another object of this invention is to provide an improved electronic analog calendar timepiece wherein a second small electric motor is used to make date corrections at the ends of the short months.

A further object of this invention is to provide an improved analog calendar timepiece wherein the date correcting mechanism links with the conventional date advancing mechanism at the ends of short months.

Still another object of this invention is to provide an improved electronic analog calendar timepiece which stores data in memory correlated to the currently displayed month.

Yet another object of this invention is to provide an improved analog calendar timepiece wherein an external member is employed to input to memory data relevant to the months of the year.

Still other objects and advantages of the invention will in part be obvious and will in part be apparent from the specification.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which:

FIG. 2 is a partial cross-sectional, elevational view of the timepiece of FIG. 1;

FIGS. 3 and 4 are partial plan views of the face of the timepiece of FIG. 1 on the 28th and 29th days of a month;

FIG. 5 is a partial plan view with parts omitted indicating a switch condition for the 29th day;

FIGS. 6, 7, and 8 are partial plan views with parts omitted showing sequential steps of operations of a date correction mechanism in the timepiece of FIG. 1;

FIGS. 9 and 10 are partial plan views indicating conditions on the 30th day of a month;

FIGS. 11 and 12 are partial plan views indicating conditions on the 31st day of a month.

DESCRIPTION OF THE PREFERRED EMBODIMENTS

Figure 1:
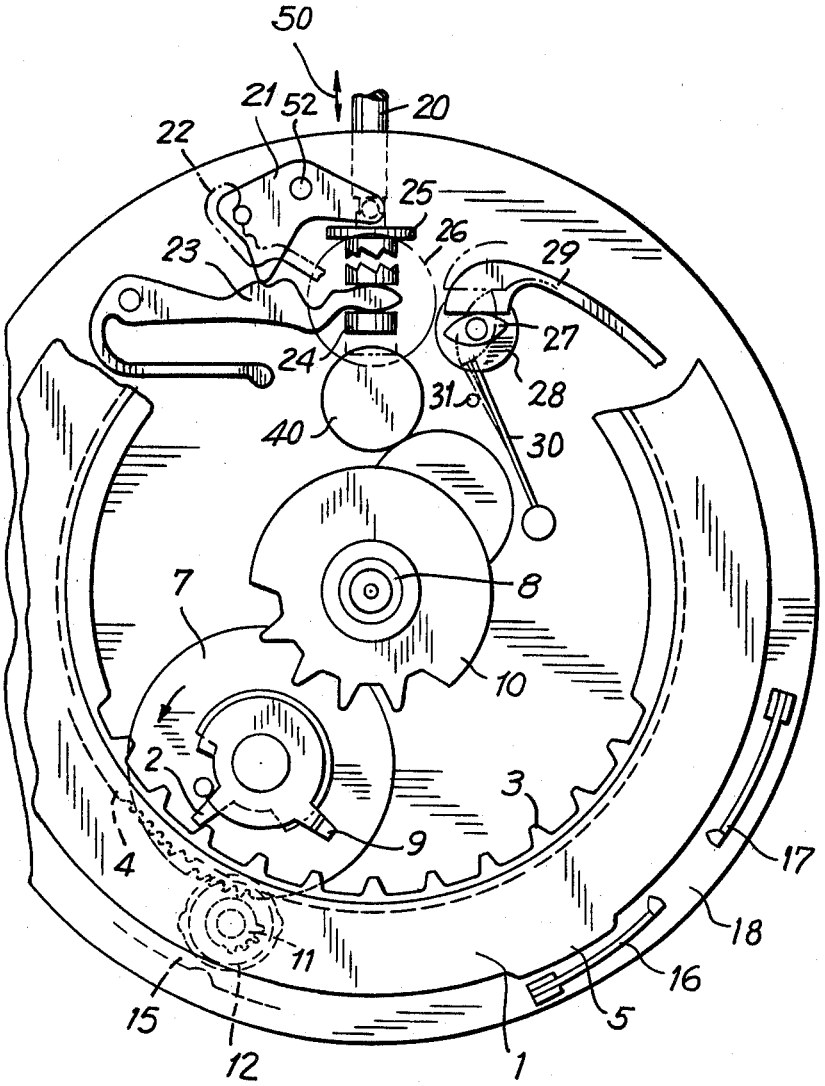
FIG. 1 is a plan view of an electronic analog timepiece of this invention with parts removed to reveal inner-mechanisms.

With reference to the figures, a date dial 1 includes gear teeth 3 which engage with a date finger 2. The date dial 1 also includes gear teeth 4 which oppose the gear teeth 3 and are distributed only partially around the date dial 1. The date dial 1 also includes a convex portion 5 locally extending from the outer perpheral edge thereof, and date marks 6 (FIG. 3) printed on the upper face of the dial 1. An hour wheel 8 for driving the hour hand (not shown) is driven by a conventional step motor (not shown) and engages a date driving wheel 7 (FIG. 2). The date driving wheel 7 is provided with the date finger 2 and a day finger 9 which advance the date dial 1 and a day star wheel 10 with a dial disc 10', respectively, once in every 24 hours as measured by the conventional timekeeping circuitry and mechanisms.

A partially toothed date advancing pinion 11 is connected to the shaft 13 of a rotor 12 so as to engage both the gear teeth 4 of the date wheel 1 and the teeth of the date advancing wheel 7, as described more fully hereinafter. The rotor 12 is a permanent magnet which is surrounded by a stator 15 having an electric coil 14 associated therewith to produce a magnetic field. In the preferred embodiment of this invention, the rotor 12 has two magnetic poles.

When the stator is not magnetized by applying a voltage to the electric coil 14, a condition which is normal except at the end of short months, the date advancing pinion 11 rests at the position shown in FIG. 1 without any engagement of the pinion teeth. When the coil 14 is energized, the rotor 12 turns under the influence of the magnetic field interacting with the magnetic poles of the rotor 12 to bring the date advancing pinion 11 to the position shown in FIG. 6 with the teeth on the pinion 11 initiating contact with the teeth on the date driving wheel 7 and the teeth 4 on the date dial 1. The motor comprising the rotor 12, shaft 13, coil 14 and the stator 15, and its operation are based on the operational principles of a conventional step motor used in electronic timepieces. This month-end date correcting motor is a second motor when it is considered that it is present in the timepiece of this invention in addition to the conventional step motor used for driving the hands and calendar functions in the conventional manner.

Elastic lever switches 16, 17 are separately connected electrically to a circuit (FIG. 13) and are insulated from the mounting plate 18. When the contact points at the free ends of the elastic portion of the lever switches 16, 17 are in contact with the convex portion 5 of the date dial 1, electrical signals are sent to the electronic circuits. It should be noted that the contact between the switches 16, 17 and the convex portion 5 occurs only when the date dial has reached a position approaching the end of the month. The distance between the contact points of the switches 16, 17 is nearly equal to one pitch spacing of the date dial 1, that is, the arc of travel of the date dial 1 in one day of operation. The convex portion 5 of the date dial 1 extends for a distance on the circumference of the date dial 1 corresponding to one pitch spacing on the dial. Accordingly, the switches 16, 17 actuate the electronic circuit, that is, turn the circuit ON in three conditions. In the first condition, only a point of the switch 16 is in contact with the convex portion 5 of the dial 1. In the second condition, points on both switches 16, 17 are in contact with a convex portion 5 of the dial 1. In the third condition only a single point of the switch 17 is in contact with the convex portion 5 of the date dial 1.

There is a fixed physical relationship between date marks 6 on the date dial 1, the partial gear teeth 4, and the convex portion 5 of the dial 1. When the 29th day is indicated in the date indicating opening 19 (FIG. 4) on the face of the timepiece, the end tooth of the partial gear teeth 4 of the date dial 1 has reached a position where said end tooth is engageable with the teeth on the date advancing pinion 11 and the switch 16 has made first contact with the convex portion 5 (FIGS. 5, 6).

When both switches 16, 17 are in contact with the convex portion of the date dial 1, the 30th day is indicated in the date indicating opening 19 (FIGS. 9, 10). When only switch 17 is in contact with the convex portion 5, the date dial 1 has rotated so that the 31st day is indicated in the opening 19 on the face of the dial (FIGS. 11, 12). When neither switch 16, 17 is in contact with the convex portion 5 of the date wheel 1, a date from the first date to the 28th date of the month is indicated in the opening 19 and the partial gear teeth 4 are not engageable with, and are disengaged from the date advancing pinion 11.

It should be noted that the date advancing pinion 11 is engageable with the gear teeth 4 of the date dial 1 from the 29th through the 31st days as indicated in the opening 19, however, actual engagement does not occur unless the pinion 11 is driven by the second motor. As explained more fully hereinafter, actuation of the motor only occurs during the months which have less than 31 days.

A setting mechanism is now described for writing-in data in the memory circuits indicating the month which is showing on the face of the dial of the timepiece of this invention. A winding stem 20 is capable of being click-stopped at a plurality of positions in the axial directions indicated by the arrow 50 in FIG. 1, by means of a setting lever 21 and a setting lever spring 22. The setting lever 21 interconnects with the stem 20, and depending on the position of the setting lever 21 and stem 20, a yoke 23 shifts a clutch wheel 24 to engage with the winding pinion 25 or with the setting wheel 40. Or the clutch wheel 24 may be entirely disengaged from both the winding pinion 25 and the setting wheel 40. The setting lever 21 pivots about the pin 52 as the stem 20 is moved in the axial directions 50. An intermediate date wheel 26 engages the winding pinion 25 which in turn engages a transmitting wheel 28 having a cam 27 attached thereto. The cam 27 is biased in one direction by the elastic jumper 29. A switch 30 connected to the electronic circuitry and insulated from the plate 18 extends within the locus of cam 27. Therefore, when the cam 27 rotates, the switch 30 is bent and comes into contact with a switch pin 31 so as to turn ON the electronic circuit. This switching operation is used to store in memory data of the present month.

In operation, after the clutch wheel 24 is engaged with the winding pinion 25 by pulling out the winding stem 20, the winding stem 20 is rotated clockwise. This causes the transmitting wheel 28 to rotate and causes the cam 27 to push the jumper 29 to the position indicated in FIG. 1 by the broken lines. Immediately after the tip of the cam 27 has passed over the bearing surface portion of the jumper 29, the cam 27 rotates quickly. At this moment, the switch 30 comes into contact with the switch pin 31 so that the circuit is turned ON. Each operation as described above of the stem 20 causes the indicator of the month to advance by one month and at the same time, as the proceedure is repeated, the electronic circuit stores in memory the number of times the circuit is turned ON. The day and the date indicators are set by operating a day-date correcting-mechanism (not shown) by setting the winding stem 20 to a day-date correcting position. When the winding stem is set back and remains in a normal neutral position, the date finger 2 and the date finger 9 advance the date dial and day star wheel 10 with dial disc 10', respectively, by a pitch distance corresponding to one day. This advancement occurs over a short period of time once in every 24 hours.

From the first day of the month until the 28th day of the month, the timepiece of this invention is driven in the conventional manner by the first motor of the timekeeping apparatus. Through the action of this first motor, the hour wheel rotates and in turn rotates the date driving wheel 7 once every 24 hours. The date finger 2 and the day finger 9 rotate with the date driving wheel 7 so that once in 24 hours the date finger 2 engages a tooth 3 on the date dial 1 and advances the date dial 1 by one pitch spacing so that the next date appears in the indicating opening 19. Also once in 24 hours, the date finger 9 engages with the teeth on the day star wheel 10 which moves the dial disc 10' (FIG. 2) so that the day, that is Sunday, Monday, etc., appears alongside the date numeral 6 in the opening 19 on the face of the timepiece (FIG. 3). During these first 28 days, the second motor and the date advancement pinion 11 are inactive and disengaged from the date driving wheel 7 and the partial teeth 4 on the date dial 1.

At about 10:00 o'clock at night on the 28th day of the month (FIG. 3), the date finger 2 starts to advance the date dial 1 (FIG. 1) by engagement with a tooth 3. At 12:00 midnight, the 29th day is indicated on the face of the dial (FIG. 4). Then, the switch 16 is contacting the convex portion 5 of the date dial 1 and turns the electronic circuit ON. This acutation of the switch 16 causes the circuit to evaluate the data stored in memory for the present month. If the comparison with the data in memory shows that the 29th day of February is being indicated on the dial, a pulse is given to the coil 14 to turn the rotor 12 in a clockwise direction so that the date advancing pinion 11 is also turned. The rotor 12 is impelled to turn 180° as a result of the interacting magnetic field of coil 14 and the two magnetic poles of the rotor 12. However, the rotor 12 is stopped before achieving the magnetically balanced position which would occur if the rotor turned 180°, because a tooth of the date advancing pinion 11 strikes upon a tooth of the date driving wheel 7 before the rotor 12 has turned 180°. Therefore, the rotor 12 does not reach a magnetically balanced position and is continuously impelled to turn clockwise by the stator 15. Consequently, the teeth on the pinion 11 engage with the teeth on the date driving wheel 7 and also with the partial gear teeth 4 of the date dial 1 as the date advancing wheel 7 turns counterclockwise. As seen in FIG. 2, the elevational position of the date advancing pinion 11 is such that the teeth on the pinion 11 may simultaneously engage the teeth 4 on the date dial 1 as well as the teeth on the date driving wheel 7. The rotational power of the date driving wheel 7, derived from the first motor and the hour wheel 8, causes the date dial 1 to turn via the intermediate action of the date advancing pinion 11 as shown in sequence in FIGS. 6, 7, and 8. The second motor does not drive the date dial 1, or the driving wheel 7. The date dial 1 advances by a pitch distance corresponding to one day appearing in the opening 19 on the face of the timepiece. At this position, the electrical power for making the rotor 12 approach a magnetically balanced position is applied. Immediately after the date advancing pinion has disengaged from the date driving wheel 7, the rotor 12 is turned instantaneously to the magnetically balanced condition such that the date advancing pinion 11 is restored to the initial position as shown in FIG. 1. At this time, the 30th day is indicated (FIG. 9) and both switches 16, 17 are in contact with the convex portion 5 of the date dial (FIG. 10). By simultaneously receiving inputs from both switches 16, 17, the electronic circuit determines that the 30th day of the month is displayed in the opening 19 on the face of the timepiece. If the data stored in the memory indicates that the present month is February, that is, the face of the timepiece is indicating inaccurately February 30th, a pre-determined pulse is applied to the coil 14 to turn the date advancing pinion 11 once more so that the date dial 1 is advanced by another day by the same procedure of engagement of the pinion 11 with the date driving wheel 7 and the teeth 4 of the date dial 1. Then, the 31st day of the month is indicated on the face of the dial and only the contact of switch 17 is closed by engagement with the convex portion 5 of the date dial 1 (FIGS. 11, 12). If the present month, as indicated by comparison with the data stored in the memory, is February, April, June, September or November, that is, any month having less than 31 days, the date dial 1 is advanced again by actuation of the second motor. The date dial is advanced by a pitch spacing corresponding to one day so as to indicate the first day of the month in the opening 19 in the face of the wristwatch.

When the contact of switch 17 disengages from the convex portion 5 of date dial 1 on the first day, the month counter which holds data identifying the present month in the electronic circuitry is advanced by one month. Accordingly, an indication of the next month is displayed (not shown) on the face of the watch. As stated above, the dated advancing operation at the end of the month is controlled by comparing the month data stored in the memory circuit with the actual month data when the switches 16, 17 are turned ON at the start of the 29th, 30th, and 31st day of the month as indicated in the opening 19 on the face of the watch. Accordingly, the date indication is advanced in quick steps from the 28th day to the first day at the end of February, and from the 30th day to the first day at the end of every 30 day month, for example, April. At the end of every 31 day month, the date wheel advancing pinion 11 remains idle as does the second motor, and the indication on the face of the watch is advanced from the 31st day to the first day by the same procedure as in a conventional electronic analog watch. More particularly, in a 31 day month, the date and day are changed by operation of the date driving wheel 7 and the date finger 2 and day finger 9.

Figure 13:
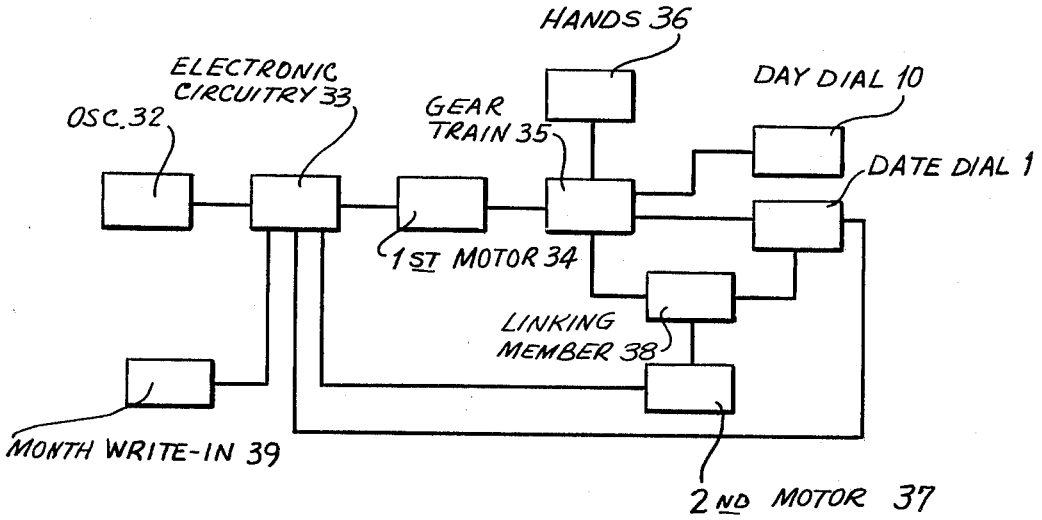
FIG. 13 is a functional block diagram of the timepiece of FIG. 1.

FIG. 13 is a functional block diagram incorporating both the electrical and mechanical functions of the timepiece of this invention. An electronic circuit 33 is comprised of an oscillator circuit including a quartz crystal vibrator 32, a divider network, a motor driving circuit and a month counter for timekeeping. The electronic circuit 33 outputs driving pulses to the first motor 34 which in turns drives the hands 36, the date dial 1 and day star wheel with dial disc 10 through the gear train 35 for timekeeping. The second motor 37 drives a linking member 38 which is capable of being connected and disconnected between the gear train 35 and the date dial 1. The electronic circuit 33 compares month information or data, which may originally be inputted by a month write-in mechanism 39, with a date signal correlated to the date dial 1 so as to give a necessary signal to the second motor 37 in the months having less than 31 days. The signal actuates the second motor 37 and connects the linking member 38 between the gear train 35 and the date dial 1 so that the date dial 1 is advanced. Actual advancement of the date dial 1 is always accomplished by means of the first motor 34 regardless of the date, however, the second motor 37 accelerates the occurrences of dial advancement at the ends of short months.

In relation to the description presented above of an embodiment of the timepiece of this invention, it should be noted that the second motor 37 includes the rotor 12, shaft 13, coil 14 and stator 15. Also, the linking member 38 includes the date advancing pinion 11, and the gear train 35 includes the date driving wheel 7.

Basically, in the timepiece of this invention plural mechanisms are provided for transmission of driving power to the date dial 1 from the gear train 35. The electronic circuit 33 determines which power transmitting mechanism, or mechanisms, is to be employed to transmit the power for driving the date dial 1. More particularly, first and second driving motors 34, 37 are provided. The first motor 34 is employed for daily advancement of the calendar date in a manner similar to conventional calendar watches. The second motor 37 is employed only for making a connection between the date driving wheel and the date dial 1 when necessary in short months, but the second motor 37 is not used directly for advancing the calendar date. Accordingly, only a low torque and low power output are required from the second motor 37 which is small and uses little electrical power. The second motor includes a rotating member of low inertia, and a month-end automatic date adjusting calendar watch according to this invention is stable against external mechanical disturbances, and is highly reliable.

The date advancing pinion 11 may be made of a plastic material in a balanced shaped so as to be less affected by external mechanical disturbances. In order to prevent breakage of the date advancing pinion 11 during date correcting operations (FIG. 7) this pinion may be constructed in a double structure or the date correcting wheel may be slipped. In order to prevent erroneous action of the switching devices due to mechanical disturbances or chattering of the switch contacts, chatter preventing circuitry may be provided which judges the ON or OFF condition of the switch, for example, by examining a continuous signal produced at regular intervals.

For determining the day at the end of the month in an alternative embodiment of this invention, one fixed switch contact may be provided adjacent to the periphery of the date dial 1 and there may be three moving contact portions on the date dial 1 corresponding to the 29th, 30th and 31st days of the month. Also, in another alternative embodiment of this invention instead of the mechanical switches described above, non-contact type switches may be provided by properly fixing a highly permeable material on the date dial and by providing a coil on the plate 18 for detecting the date. The coil detects the date by variations of the electric characteristics resulting from the positional relationship between the material of high permeability on the moving date dial and the coil on the fixed plate. For example, the coil would detect whether the permeable material was adjacent to the coil or separated from the coil.

This invention readily provides an automatic month-end date adjusting calendar watch which not only has a mechanical analog system, but also has electronic circuitry. This combined system of mechanics and electronics can be applied not only to the calendar wheels as described above but also to any other advancing mechanisms.

It will thus be seen that the objects set forth above, among those made apparent from the preceding description, are efficiently attained and, since certain changes may be made in the above construction without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. An electronic analog timepiece comprising:

electronic circuitry including means for providing timekeeping signals;

analog display means for visibly indicating timekeeping functions;

electro-mechanical means operating in response to said timekeeping signals to advance said analog display means, whereby visible indicia of said timekeeping functions are changed at regular prescribed intervals, said electro-mechanical means including first motor-means for advancing said display means at said regular intervals;

means for enabling the change of at least one of said timekeeping functions at an irregular interval, said means for enabling including second motor means and linking means, means for actuation of said second motor means, actuation of said second motor means causing said linking means to engage with said electro-mechanical means, said engagement enabling the change of said at least one timekeeping function, said first motor means changing said at least one timekeeping function whenever said linking means are engaged.

2. The electronic analog timepiece of claim 1 wherein said means for actuating said second motor means operates at prescribed irregular intervals.

3. The electronic analog timepiece of claim 1, wherein operation of said second motor means is intermittent.

4. The electronic analog timepiece of claim 2 wherein said means for actuating said second motor means include electrical switch means and data stored in said electronic circuitry, said switch means being operated at said prescribed irregular intervals, said second motor means being actuated upon the operation of said switch means and the coincidence of said stored data with present timekeeping signals.

5. An electronic analog timepiece comprising:

electronic circuitry including means for providing timekeeping signals;

analog display means for visibly indicating timekeeping functions, said timekeeping functions including at least the date;

electro-mechanical means operating in response to said timekeeping signals to advance said analog display means whereby visible indicia of said timekeeping functions are changed at regular prescribed intervals, said date function being advanced at the end of each day, said electromechanical means including first motor means for advancing said display means at regular intervals; and means for enabling the advancement of at least said date function at irregular intervals, said means for enabling including second motor means and linking means, means for actuation of said second motor means, actuation of said second motor means causing said linking means to engage with said electromechanical means, said engagement enabling the advance of at least said date function, said first motor means changing said date function whenever said linking means are engaged.

6. The electronic analog timepiece of claim 5 wherein said means for actuating said second motor means operates at prescribed irregular intervals.

7. The electronic analog timepiece of claim 6 wherein said means for actuating said second motor means includes electrical switch means and data stored in said electronic circuitry, said switch means being operated at said irregular intervals, said second motor means being actuated upon the concurrent operation of said switch means and the coincidence of said stored data with present timekeeping signals.

8. The electronic analog timepiece of claim 7 wherein said date function is displayed on a date dial.

9. The electronic analog timepiece of claim 8 and further including first gear teeth on said date dial, said electro-mechanical means including a rotating finger, said finger rotating once per day, said finger engaging said first gear teeth once per day and advancing said date dial at said regular intervals by a pitch spacing whereby the next date on said date dial is visibly indicated.

10. The electronic analog timepiece of claim 9 wherein said date dial further includes second gear teeth, and said electro-mechanical means may alternatively drive said date dial either through said rotating finger and said first gear teeth or through said linking means and said second gear teeth, said operation through said linking means and second gear teeth occurring upon actuation of said second motor means at said irregular intervals.

11. The electronic analog timepiece of claim 10 wherein said electro-mechanical means further includes a gear rotating once every 24 hours and said linking means includes a pinion, said pinion engaging said rotating gear and said second gear teeth upon actuation of said second motor means.

12. The electronic analog timepiece of claim 11 wherein said gear rotating once in 24 hours drives said pinion and said date dial when said pinion engages said gear.

13. The electronic analog timepiece of claim 12 wherein said second motor means includes a step-motor, said step-motor when actuated driving said pinion into said engagement with said rotating gear and said gear teeth.

14. The electronic analog timepieces of claim 7 wherein said switch means are operated when said date function indicates the 29th, 30th, or 31st day.

15. The electronic analog timepiece of claim 12 wherein said switch means are operated when said date function indicates the 29th, 30th, or 31st day.

16. The electronic analog timepiece of claim 14, wherein when the present month is February said stored data and said switch means cause said date dial to move automatically from a position indicating the 29th day to positions indicating the 30th day, 31st day and first day of the next month consecutively whereby month-end corrections are made.

17. The electronic analog timepiece of claim 14 wherein when the present month is a 30 day month, the stored data causes said date dial to automatically move from a position indicating the 31st day to a position indicating the first day of the next month whereby month-end corrections are made.

18. The electronic analog timepiece of claim 16 wherein said month-end corrections are made substantially immediately upon the indication of an incorrect date at the end of a month.

19. The electronic analog timepiece of claim 17 wherein said month-end corrections are made substantially immediately upon the indication of an incorrect date at the end of a month.

20. The electronic analog timepiece of claim 4 wherein at least part of said stored data is inputted by operation of an external member.

21. The electronic analog timepiece of claim 7 wherein at least part of said stored data is inputted by operation of an external member.

22. The electronic analog timepiece of claim 18 wherein each operation of said external member advances at least one of said displayed time functions and inputs data representing the number of said operations of said external member.

23. The electronic analog timepiece of claim 20 wherein each operation of said external member advances at least one of said displayed time functions and inputs data representing the number of said operations of said external member.

24. An electronic analog timepiece comprising a gear train including wheels driven in connection with said gear train, and having indication hands and a calendar displaying member wherein a calendar advancing means, a means for enabling calendar advancement and a means for detecting the position of said calendar displaying member are provided, said calendar advancing means having a first calendar advancing member for advancing said calendar displaying member periodically in connection with said gear train, said enabling means comprising electro-magnetic clutch means operatively connecting said calendar displaying member with said gear train, said electromagnetic clutch means being operatively coupled with said means for detecting the position of said calendar displaying member and being operative to enable the advance of said calendar displaying member at the end of the month having twenty-eight or twenty-nine or thirty days.

* * * * *